US010245501B2

(12) United States Patent
Klimeck

(10) Patent No.: US 10,245,501 B2
(45) Date of Patent: Apr. 2, 2019

(54) ADJUSTABLE BILLIARDS BRIDGE DEVICE

(71) Applicant: Bradley Klimeck, Denver, CO (US)

(72) Inventor: Bradley Klimeck, Denver, CO (US)

( * ) Notice: Subject to any disclaimer, the term of this patent is extended or adjusted under 35 U.S.C. 154(b) by 0 days.

(21) Appl. No.: 15/635,504

(22) Filed: Jun. 28, 2017

(65) Prior Publication Data

US 2018/0104568 A1 Apr. 19, 2018

Related U.S. Application Data

(60) Provisional application No. 62/408,741, filed on Oct. 15, 2016.

(51) Int. Cl.
*A63D 15/10* (2006.01)

(52) U.S. Cl.
CPC ..... *A63D 15/105* (2013.01); *A63B 2225/09* (2013.01); *A63B 2243/002* (2013.01)

(58) Field of Classification Search
CPC ..... A63D 15/10; A63D 15/08; A63D 15/105; A63B 2225/09; A63B 2243/002
USPC ..... 473/2, 43, 46, 42, 44; 248/528
See application file for complete search history.

(56) References Cited

U.S. PATENT DOCUMENTS

D485,319 S * 1/2004 Keller ..... D21/726
D486,193 S * 2/2004 Keller ..... D21/726
7,837,598 B1 * 11/2010 Boozel, Jr. ..... A63B 21/151 482/38
9,095,946 B2 * 8/2015 Kotula ..... B25J 15/0061
2006/0025228 A1 * 2/2006 Light ..... A63D 15/105 473/42
2007/0178981 A1 * 8/2007 Grainger ..... A63D 15/105 473/42

FOREIGN PATENT DOCUMENTS

GB 2157576 A * 10/1985 ..... A63D 15/086

* cited by examiner

*Primary Examiner* — John E Simms, Jr.
*Assistant Examiner* — Rayshun K Peng
(74) *Attorney, Agent, or Firm* — Patentfile, LLC; Bradley C. Fach; Steven R. Kick

(57) ABSTRACT

An adjustable billiards bridge device may comprise a body having a first end and an opposing second end with one or more central cue surfaces disposed on the body. A first leg may be pivotally coupled to the first end of the body, and the first leg may have one or more peripheral cue surfaces. A second leg may be pivotally coupled to the second end of the body, and the second leg may have one or more peripheral cue surfaces. A coupler may be positioned on the body between the first end and the second end. The coupler may be configured to couple the device to a positioning stick which may be used by an individual to position the device on a billiards table. The first leg and second leg may be individually movable relative to the body to enable the device to assume a plurality of configurations.

15 Claims, 6 Drawing Sheets

ADJUSTABLE BILLIARDS BRIDGE DEVICE

CROSS REFERENCE TO RELATED APPLICATIONS

This application claims priority to and the benefit of the filing date of U.S. Provisional Application No. 62/408,741, filed on Oct. 15, 2016, entitled "Multiple leg adjustable pool billiards cue bridge/rest device", which is hereby incorporated by reference in its entirety.

FIELD OF THE INVENTION

This patent specification relates to the field of bridge devices for use in billiards. More specifically, this patent specification relates to an adjustable bridge device for use in billiards.

BACKGROUND

A billiards bride or cue rest is a device that is used by setting the head of the bridge on a spot on a pool table that is too far away for a pool or snooker player to reach without using something to aid the player. The length of most pool tables is seven or eight feet across. Some snooker table and other billiards tables can be nine feet or longer. When shooting at balls at the far end of a billiards table a player cannot reach the balls to shoot them. To use a bridge, the head of the bridge is placed close to the cue ball usually using a shaft attached to the bridge. Once the bridge is placed on the table at the proper spot, the player can rest the end of the cue stick on the bridge head to enable the player to more easily line up the cue stick with the cue ball to shoot the cue ball at the desired target.

Most currently available billiards bridges or cue rests basically are a solid piece of plastic, aluminum, or brass that has spots to rest a cue stick so that the player only need to hold up the butt of the cue stick. These bridges tend to be rectangular in shape and have one to four positions to lay the bridge thereby only allowing a finite and limited number of cue stick support positions and elevations to play the correct height on the cue ball. For example, these bridges are unable to position the bridge head over or in between balls and cannot be used on the pool table rails for support. They can only be used on the table surface in front of or behind balls to support the end of the cue stick on the other end of the table. While this is adequate for most shots using a bridge, there are often shots that come up that if one could only place the bridge at any desired location on the table would make the shot much easier to shoot and be more accurate.

Therefore, there exists a need for novel billiard bridge devices. There is also a need for novel billiard bridge devices that provide many cue stick support positions that allows for greater flexibility when setting up a shot. Finally, a need exists for novel billiard bridge devices that can be used on any table surface location in front of or behind balls to support the end of the cue stick on the other end of the table.

BRIEF SUMMARY OF THE INVENTION

An adjustable billiards bridge device is provided which comprise cue surfaces which may support a cue stick and the movements of the cue stick across the cue surfaces. The device may be moved into different configurations to enable the cue surfaces to be positioned a desired height and distance from a billiards ball that the user intends to strike with a cue stick while the cue stick may be supported on a cue surface that is a desired height and distance from the billiards ball. In some embodiments, the device may comprise a body having a first end and an opposing second end with one or more central cue surfaces disposed on the body. A first leg may be pivotally coupled to the first end of the body, and the first leg may have one or more peripheral cue surfaces. A second leg may be pivotally coupled to the second end of the body, and the second leg may have one or more peripheral cue surfaces. A coupler may be positioned centrally on the body between the first end and the second end. The coupler may be configured to couple the device to a positioning stick which may be used by an individual to position the device on a billiards table or other surface. The first leg and second leg may be individually movable relative to the body to enable the device to assume a plurality of configurations.

In further embodiments, the device may comprise one or more body spurs which may be coupled to the body. Optionally, a body spur may comprise a central cue surface that is concave in shape.

In further embodiments, the device may comprise one or more leg spurs which may be coupled to a first leg and/or a second leg. Optionally, a leg spur may comprise a peripheral cue surface that is concave in shape.

In still further embodiments, the body may comprise detents on both the first end and second end. The detents of the first end may be engaged to detents on the first leg, and detents of the second end may be engaged to detents on the second leg. The detents of the first end may be tensioned into contact with the detents of the first leg by a first spring, and the detents of the second end may be tensioned into contact with the detents of the second leg by a second spring. The detents may govern the movement of the legs relative to the body.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
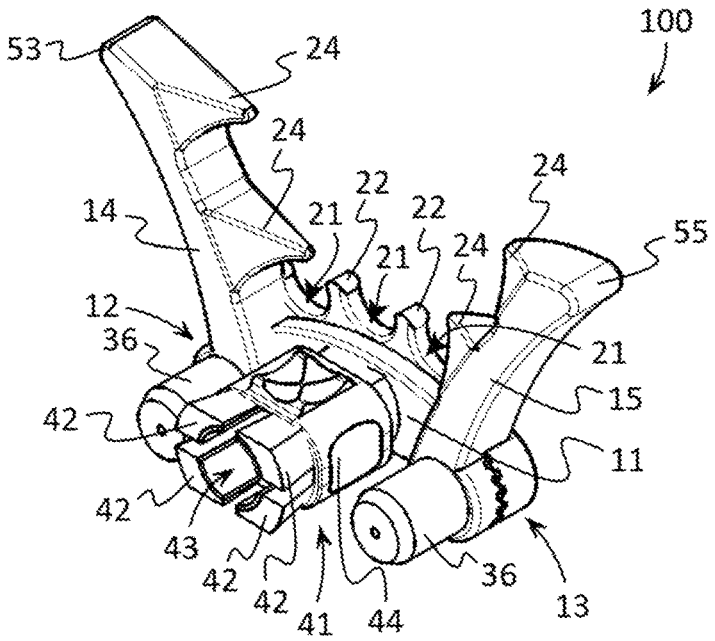
FIG. 1 depicts a perspective view of an example of an adjustable billiards bridge device having a first arm and a second arm both moved above the body according to various embodiments described herein.
Figure 2:
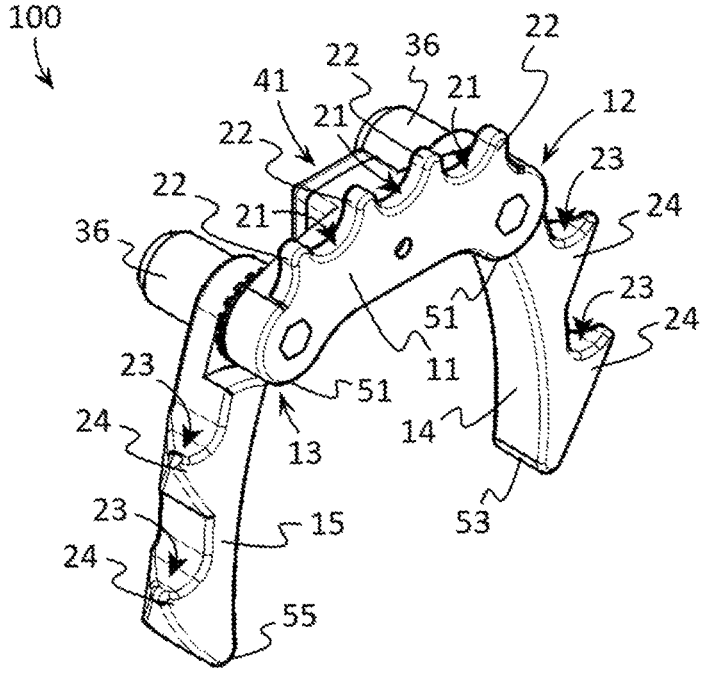
FIG. 2 illustrates a reverse perspective view of another example of an adjustable billiards bridge device having a first arm and a second arm both moved below the body according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new adjustable bridge device for use in billiards is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIG. 1 illustrates an example of an adjustable billiards bridge device ("the device") 100 according to various embodiments. In some embodiments, the device 100 may comprise a body 11 having a first end 12 and an opposing second end 13 with one or more cue surfaces 21 disposed on the body 11. A first leg 14 may be pivotally coupled to the first end 12 of the body 11, and the first leg 14 may have one or more cue surfaces 21. A second leg 15 may be pivotally coupled to the second end 13 of the body 11, and the second leg 15 may have one or more cue surfaces 21. A coupler 41 may be positioned centrally on the body 11 between the first end 12 and the second end 13. The coupler 41 may be configured to couple the device 100 to a positioning stick 200 (FIGS. 4-9), such as a cue stick 201 (FIGS. 4 and 5), which may be used by an individual to position the device 100 on a billiards table. The first leg 14 and second leg 15 may be individually movable relative to the body to enable the device to assume a plurality of configurations.

In some embodiments, the device 100 may comprise a body 11 that is elongated. The body 11 may be elongated so that the first end 12 may be separated from the second end 13 a distance or length that is greater than the width and the height of the body 11. In other embodiments, the first end 12 may be separated from the second end 13 a distance or length that is approximately equal to the width and/or the height of the body 11. In some embodiments, the first end 12 may be separated from the second end 13 a distance of approximately one to seven inches and more preferably a distance of approximately two to five inches.

The body 11 may comprise one or more central cue surfaces 21 which may be configured to support and guide the movement of a billiard cue across the body 11. In some embodiments, a central cue surface 21 may be formed by one or more body spurs 22. A body spur 22 may extend above or away from the body 11. Each body spur 22 may comprise one or more central cue surfaces 21. In preferred embodiments, a central cue surface 21 of one body spur 22 may be continuous with a central cue surface 21 of a second body spur 22. A central cue surface 21 of the body 11 may be configured in a plurality of shapes, such as the concave curved shape illustrated in FIGS. 1-11. In further embodiments, a central cue surface 21 of the body 11 may be configured with a U-shape, a V-shape, a C-shape, a J-shape, a concave semi-circular shape, or any other type of concave shape. In further preferred embodiments, the body 11 may comprise three central cue surfaces 21 which may be formed between four body spurs 22. In alternative embodiments, the body 11 may comprise one or more central cue surfaces 21 which may be formed into the body 11 without a body spur 22.

Figure 10:
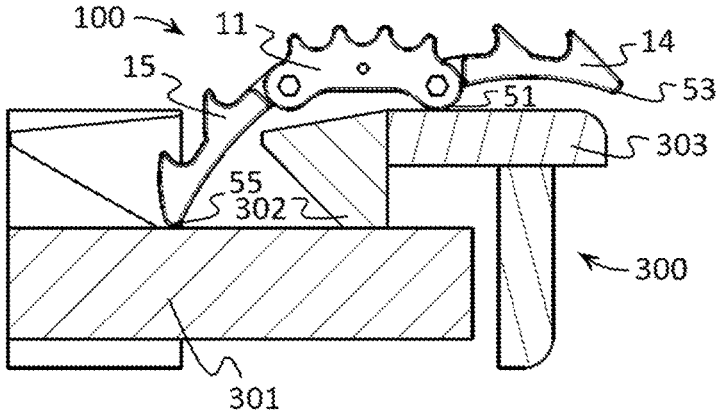
FIG. 10 depicts an elevation view of an example of an adjustable billiards bridge device in a first exemplary configuration according to various embodiments described herein.
Figure 11:
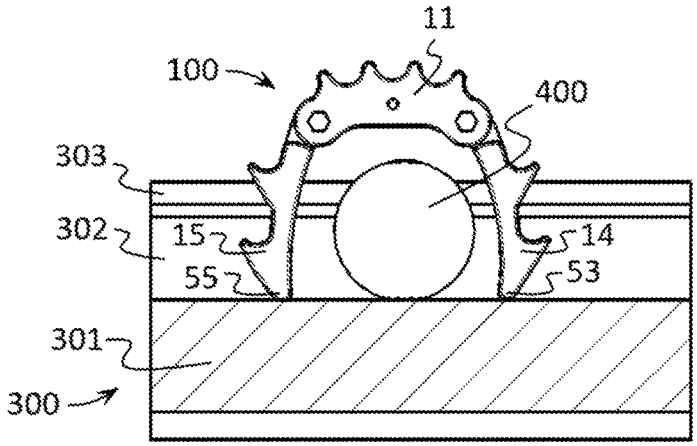
FIG. 11 illustrates an elevation view of an example of an adjustable billiards bridge device in a second exemplary configuration according to various embodiments described herein.
Figure 12:
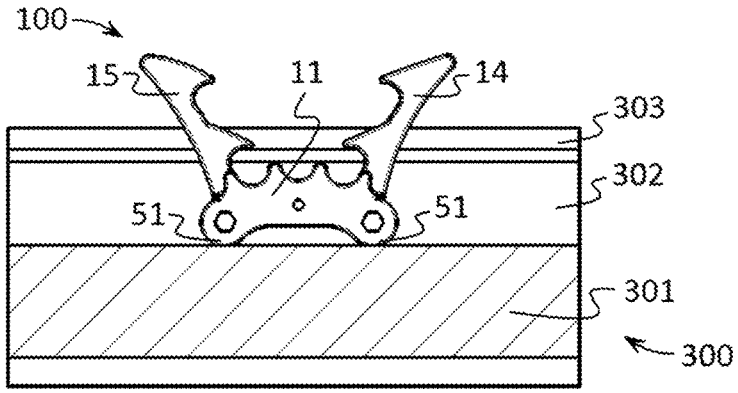
FIG. 12 shows an elevation view of an example of an adjustable billiards bridge device in a third exemplary configuration according to various embodiments described herein.

In some embodiments, the body 11 may comprise one or more body supports 51 which may be positioned on the body 11 preferably on a side of the body 11 which is opposite to the one or more body spurs 22 and central cue surfaces 21. A body support 51 may comprise a protrusion which may extend below the body 11 to form a point of contact between the body 11 and an object upon which the body 11 may be rested, such as on a play field 301 (FIGS. 10-12), cushion 302 (FIGS. 10-12), and/or rail 303 (FIGS. 10-12) of a billiards table 300 (FIGS. 10-12). In preferred embodiments, the body 11 may comprise a first body support 51 positioned on or proximate to the first end 12 and a second body support 51 positioned on or proximate to the second end 13. A body support 51 may comprise a rounded shape, a curved shape, an angular shape or pointed shape, or any other shape suitable for contacting portions of a billiards table 300.

The body 11, one or more body spurs 22, and one or more cue surface 21 of a body 11 may preferably be made of or comprise substantially rigid material(s) such as steel alloys, aluminum, aluminum alloys, copper alloys, any other type of metal or metal alloy, any type of ceramic, various types of hard plastics, such as polyethylene (PE), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid.

The device 100 may comprise one or more legs, such as a first leg 14 and a second leg 15. Preferably, one or more legs 14, 15, may comprise one or more peripheral cue surfaces 23 which may be configured to support and guide the movement of a billiard cue across a leg 14, 15. In some embodiments, a peripheral cue surface 23 may be formed by one or more leg spurs 24. A leg spur 24 may extend above or away from a leg 14, 15. Each leg spur 24 may comprise one or more peripheral cue surfaces 23. In some embodiments, a peripheral cue surface 23 of one leg spur 24 may be separate and distinct with a peripheral cue surface 23 of a second leg spur 24 on the same leg 14, 15. For example, a peripheral cue surface 23 of one leg spur 24 on the first leg 14 may not be continuous with a peripheral cue surface 23 of a second leg spur 24 on the first leg 14. In alternative embodiments, a peripheral cue surface 23 of one leg spur 24 may be continuous with a peripheral cue surface 23 of a second leg spur 24 on the same leg 14, 15. For example, a peripheral cue surface 23 of one leg spur 24 on the first leg 14 may be continuous with a peripheral cue surface 23 of a second leg spur 24 on the first leg 14.

A peripheral cue surface 23 of a leg 14, 15, may be configured in a plurality of shapes, such as the concave curved shape illustrated in FIGS. 1-11. In further embodiments, a peripheral cue surface 23 of a leg 14, 15, may be configured with a U-shape, a V-shape, a C-shape, a J-shape, a concave semi-circular shape, or any other type of concave shape. In further preferred embodiments, a leg 14, 15, may comprise two separate peripheral cue surfaces 23, with each peripheral cue surface 23 formed onto or by a single leg spur 24. In alternative embodiments, a leg 14, 15, may comprise one or more peripheral cue surfaces 23 which may be formed into a leg 14, 15, without a leg spur 24. The one or more legs 14, 15, one or more leg spurs 24, and one or more peripheral cue surfaces 23 may preferably be made of or comprise any substantially rigid material(s) such as those which may be used to form the body 11, a body spur 22, and a central cue surface 21.

In some embodiments, a first leg 14 may comprise one or more first leg supports 53. Optionally, a first leg support 53 may be positioned on the end of the first leg 14 which is opposite to the end or portion of the first leg 14 which is coupled to the body 11. A first leg support 53 may comprise a protrusion which may extend away the leg spurs 24 and peripheral cue surfaces 23 of the first leg 14 to form a point of contact between the first leg 14 and an object upon which the first leg 14 may be rested, such as on a play field 301, cushion 302, and/or rail 303 of a billiards table 300. A first leg support 53 may comprise a rounded shape, a curved shape, an angular shape or pointed shape, or any other shape suitable for contacting portions of a billiards table 300. In preferred embodiments, a first leg support 53 may be separated from the end or portion of the first leg 14 which is coupled to the body 11 a distance of approximately one to seven inches and more preferably a distance of approximately two to five inches.

Similarly, and in some embodiments, a second leg 15 may comprise one or more second leg supports 55. Optionally, a second leg support 55 may be positioned on the end of the second leg 15 which is opposite to the end or portion of the second leg 15 which is coupled to the body 11. A second leg support 55 may comprise a protrusion which may extend away the leg spurs 24 and peripheral cue surfaces 23 of the second leg 15 to form a point of contact between the second leg 15 and an object upon which the second leg 15 may be rested, such as on a play field 301, cushion 302, and/or rail 303 of a billiards table 300. A second leg support 55 may comprise a rounded shape, a curved shape, an angular shape or pointed shape, or any other shape suitable for contacting portions of a billiards table 300. In preferred embodiments, a second leg support 55 may be separated from the end or portion of the second leg 15 which is coupled to the body 11 a distance of approximately one to seven inches and more preferably a distance of approximately two to five inches.

In preferred embodiments, a first leg 14 may be movably coupled to the first end 12 and a second leg 15 may be movably coupled to the second end 13. Any suitable movably coupling may be used to couple a first leg 14 and second leg 15 to the body 11, including a hinged coupling such as a butt hinge, barrel hinge, concealed hinge, piano hinge, or any other hinge, a pivotal or rotating coupling such as a rivet, bearing, knuckle joint, universal joint, male ball joint and female socket joint, or any other pivotal or rotating coupling, or any other method of movably coupling two objects together so that one object may be moved, pivoted, rotated, or the like, relative to the other object.

Figure 3:
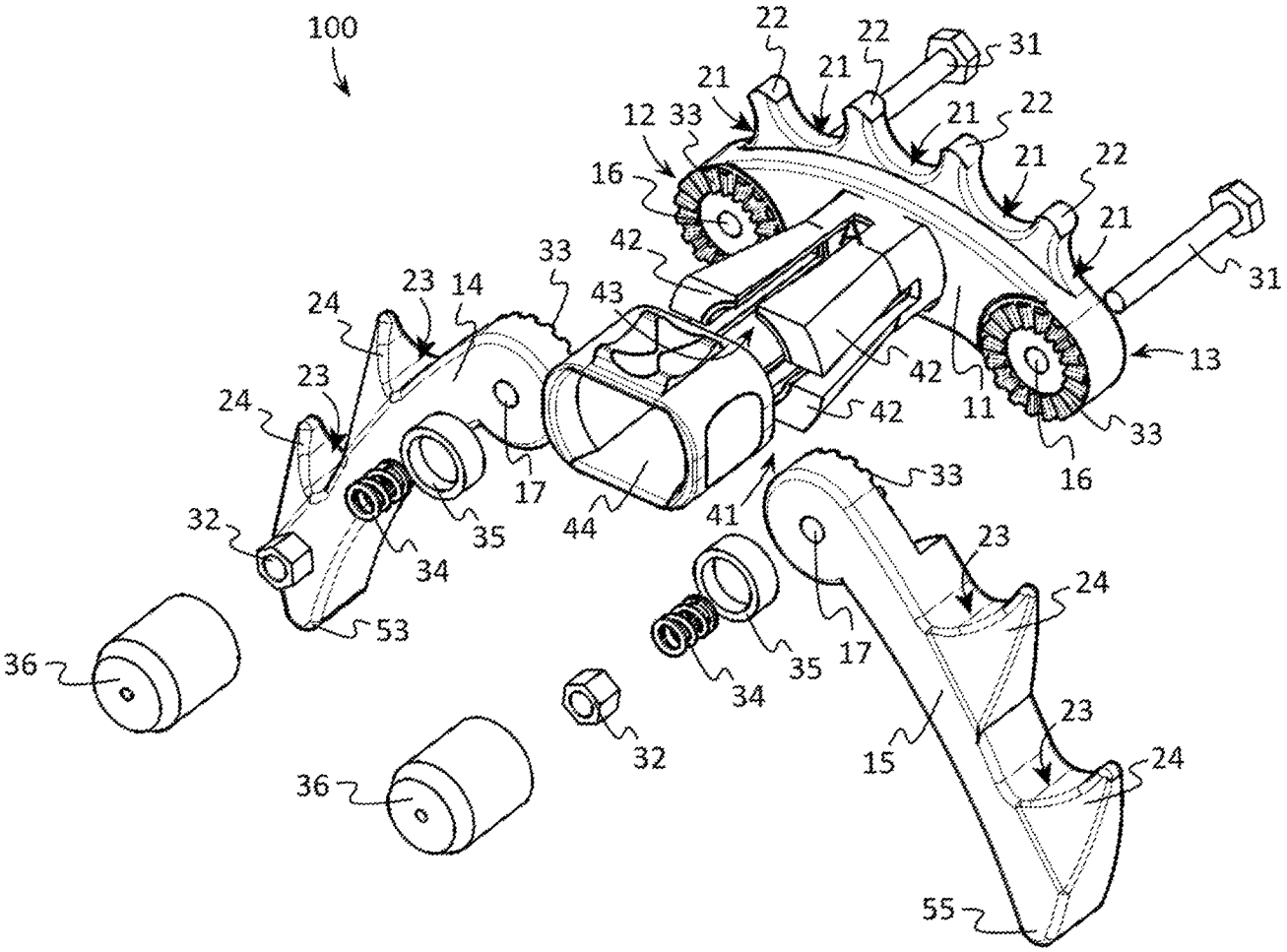
FIG. 3 shows a perspective exploded view of an example of an adjustable billiards bridge device according to various embodiments described herein.

FIG. 3 shows a perspective exploded view of an example of an adjustable billiards bridge device 100 according to various embodiments described herein. In some embodiments, one or more fasteners, such as a male fastener 31 and a female fastener 32 may be configured to removably couple a leg 14, 15, to the body 11. In further embodiments, a male fastener 31 may be inserted through a body aperture 16 of the body 11 and through a leg aperture 17 of a leg 14, 15, and a female fastener 32 may be coupled to the male fastener 31. The leg 14, 15, may then be moved or pivoted relative to the body 11 around the axis provided by the male fastener 31. A male fastener 31 may comprise a rivet, a male threaded fastener such as a screw, bolt, or the like, or any other fastener which may be inserted through a body aperture 16 and/or a leg aperture 17. Optionally, a male fastener 31 may be integrally formed or otherwise coupled to a leg 14, 15, or the body 11. A female fastener 32 may comprise a female threaded fastener such as a hex nut, wing nut, or the like, or any other fastener which may receive a male fastener 31. Optionally, a female fastener 32 may be integrally formed or otherwise coupled to a leg 14, 15, or the body 11.

In some embodiments, the device 100 may comprise one, two, three, four, five, six, seven, eight, or more, such as a plurality of, detents 33 which may be configured to contact another element of the device 100 to govern the movement of a leg 14, 15, relative to the body 11. In further embodiments, the device 100 may comprise one or more detents 33 at an interface between the first leg 14 and the body, and the device 100 may comprise one or more detents 33 at an interface between the second leg 15 and the body 11 and with the detents 33 used to hold the second legs 14, 15, in one or more temporarily fixed positions relative to the body 11. For example, the device 100 may comprise a spring loaded joint and one or more detents 33 disposed at an interface between the second leg 15 and the body 11, and the spring loaded ball and detents 33 may form a mechanical arrangement to hold the second leg 15 in one or more temporarily fixed positions relative to the body 11.

In preferred embodiments, the device 100 may comprise one or more springs 34 which may be configured to tension a leg 14, 15, or an element coupled to the leg 14, 15, into contact with the body 11 or with an element coupled to the body 11. For example, the body 11 may comprise a spring 34 configured to tension the first arm 14 towards the body 11, and both the first arm 14 and body 11 may comprise one or more detents 33. The spring 34 may tension the detents 33 of the second arm and second end 13 of the body 11 into contact to form a mechanical arrangement to hold the second leg 15 in one or more temporarily fixed positions relative to the body 11. In another example, the body 11 may comprise one or more detents 33 on both the first end 12 and on the second end 13. The first leg 14 may comprise one or more detents 33, and the second leg 15 may comprise one or more detents 33. The detents 33 of the first end 12 may be tensioned into contact with the detents 33 of the first leg 14 by a first spring 34, and the detents 33 of the second end 13 may be tensioned into contact with the detents 33 of the second leg 15 by a second spring 34 so that the detents 33 and springs 34 may form a mechanical arrangement to hold the legs 14, 15, in one or more temporarily fixed positions relative to the body 11.

Optionally, the device 100 may comprise one or more washers 35 which may be configured to limit or govern the amount of tension that a spring 34 may exert on an interface between a leg 14, 15, and the body 11. In further embodiments, the device 100 may comprise one or more caps 36 which may be configured to cover portions of a male fastener 31, female fastener 32, spring 34, and/or washer 35. In still further embodiments, a washer 35 may be used to frictionally couple a cap 36 to an element of the device 100 such as to a spring 34, male fastener 31, and/or female fastener 32.

Figure 4:
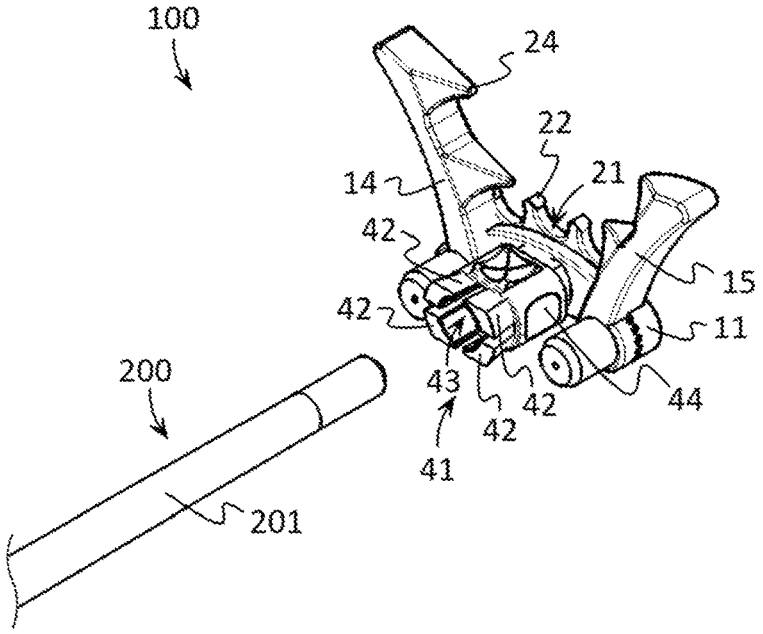
FIG. 4 depicts a perspective view of an example of an adjustable billiards bridge device and a cue stick according to various embodiments described herein.
Figure 5:
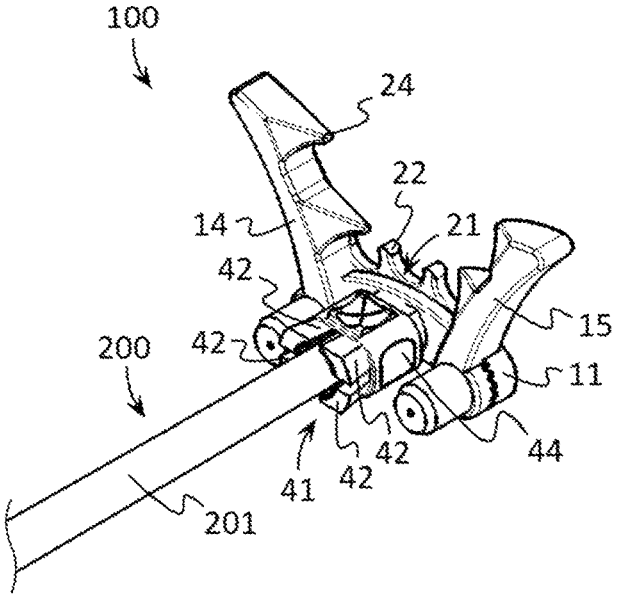
FIG. 5 illustrates a perspective view of an example of an adjustable billiards bridge device coupled to a cue stick according to various embodiments described herein.

The device 100 may comprise one or more couplers 41. A coupler 41 may be configured to couple the device 100 to a positioning stick 200 (FIGS. 4-9), such as a cue stick 201 (FIGS. 4 and 5). A coupler 41 may comprise any device or method for coupling the device 100 to a positioning stick 200. A coupler 41 may be positioned anywhere on the body 11 or on a leg 14, 15. Preferably, a coupler 41 may be positioned centrally on the body 11 between the first end 12 and the second end 13. Generally, a positioning stick 200 may comprise any elongated object, such as a pole, rod, or stick, which may be used by an individual to position the device 100 on a billiards table. A cue stick 201 may comprise a cue or stick which is configured to impact or strike a billiards ball 400 (FIG. 11).

As shown in FIGS. 4 and 5, a coupler 41 may be configured to be removably coupled to a cue stick 201. In some embodiments, a coupler 41 may comprise at least two fingers 42 which may form an aperture 43 or opening between the fingers 42. The aperture 43 may be shaped to receive a portion of a cue stick 201 so that an end, such as the tip end or bumper end, of the cue stick 201 may be inserted into the aperture 43. The fingers 42 may be configured to move towards each other, such as by being made from a flexible material, such as a natural and/or synthetic rubber material such as latex rubber, forms of the organic compound isoprene, Polyacrylate Rubber, Ethylene-acrylate Rubber, Polyester Urethane, a flexible plastic such as high-density polyethylene (HDPE), polyvinyl chloride (PVC), polypropylene (PP), Polystyrene (PS), Polycarbonate (PC), low density polyethylene (LDPE), or any other flexible material. A sleeve 44 may be positioned around the fingers 42, and the sleeve 44 may be configured to draw the fingers 42 towards each other when the sleeve 44 is moved relative to the body 11. By moving the fingers 42 towards each other, the size of the aperture 43 may be decreased thereby frictionally coupling or engaging a portion of a positioning stick 200, such as a cue stick 201, to the device 100 within the aperture 43. In preferred embodiments, the sleeve 44 may be configured to draw the fingers 42 towards each other when the sleeve 44 is moved away from the body 11.

Figure 6:
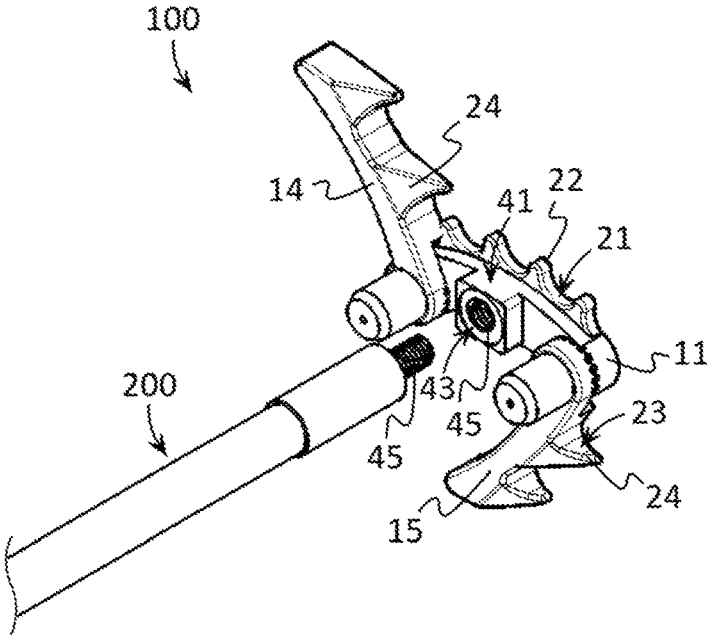
FIG. 6 shows a perspective view of an example of an adjustable billiards bridge device and a positioning stick according to various embodiments described herein.
Figure 7:
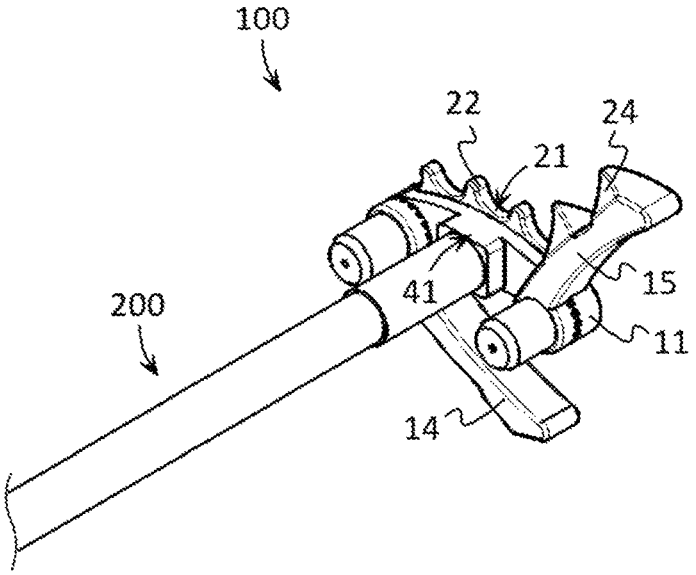
FIG. 7 depicts a perspective view of an example of an adjustable billiards bridge device coupled to a positioning stick according to various embodiments described herein.

Turning now to FIGS. 6 and 7, in some embodiments, the device 100 may be configured to be removably coupled to a positioning stick 200 with threading 45. For example, a portion of a positioning stick 200 may comprise threading 45 and a coupler 41 of the device 100 may comprise threading 45. The threading 45 of the positioning stick 200 may be engaged with the threading 45 of the coupler 41 to threadedly and removably couple the coupler 41 to the positioning stick 200.

Figure 8:
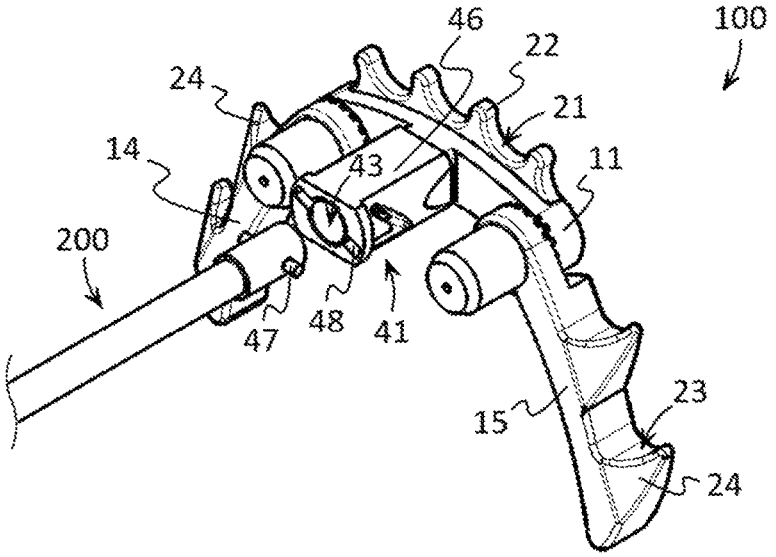
FIG. 8 illustrates a perspective view of an alternative example of an adjustable billiards bridge device and an alternative positioning stick according to various embodiments described herein.
Figure 9:
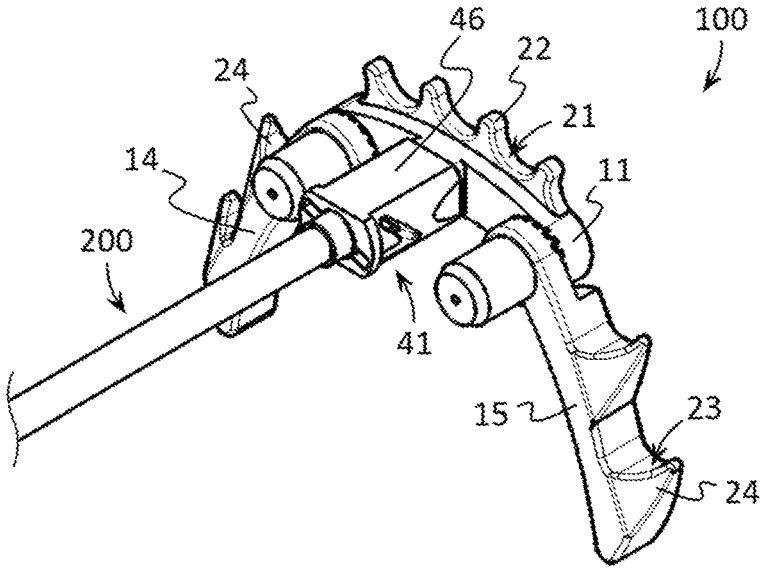
FIG. 9 shows a perspective view of an alternative example of an adjustable billiards bridge device coupled to an alternative positioning stick according to various embodiments described herein.

Referring to FIGS. 8 and 9, in some embodiments, a coupler 41 may comprise a bayonet mount 46 which may be configured to be removably coupled to a positioning stick 200 with a bayonet mount style engagement. For example, a positioning stick 200 may comprise a cylindrical male side with one or more radial pins 47, and the coupler 41 may comprise a bayonet mount 46 having a female receptor with matching L-shaped slot(s) 48 and spring(s) to keep the two parts locked together. The slots 48 may be shaped like a capital letter L with serif (a short upward segment at the end of the horizontal arm) and the pin(s) 47 may slide into the vertical arm of the L, rotates across the horizontal arm, then is pushed slightly upwards into the short vertical "serif" by a spring with the positioning stick 200 and bayonet mount 46 no longer free to rotate and be separated unless pushed down against the spring until the pin(s) 47 are out of the "serif" of the slot(s) 48.

In other embodiments, coupler 41 may comprise an aperture 43 and a portion of a positioning stick 200, such as a cue stick 201, may be removably coupled to the device 100 within the aperture 43 with a fastener such as a male threaded fastener 31, rivet, adhesive, or any other coupling method. In alternative embodiments, a positioning stick 200, such as a cue stick 201, may be integrally formed with or otherwise coupled to a coupler 41 so that the positioning stick 200 and coupler 41 may not be separated. In still further embodiments, the device 100 may comprise a positioning stick 200 which may be coupled to a coupler 41.

As perhaps best shown in FIGS. 10-12, the device 100 may comprise a first leg 14 and a second leg 15, and each leg 14, 15, may be movably coupled to the body 11 so that each leg 14, 15, may be independently moved relative to the body 11. By moving the legs 14, 15, relative to the body 11, a user may be able to position the device 100 in different configurations to enable a desired leg 14, 15, or portion of the body 11 to contact a portion of a billiards table 300, such as the play field 301, cushions 302, and/or rails 303. Additionally, by moving the device 100 into different configurations, the cue surfaces 21, 23, may be positioned a desired height and distance from a billiards ball 400 (FIG. 11) that the user intends to strike with a cue stick while the cue stick may be supported on a cue surface 21, 23, that is a desired height and distance from the billiards ball 400 (FIG. 11).

FIG. 10 depicts an example of the device 100 in a first exemplary configuration in which the first leg 14 is pivoted or moved generally in-line with the body 11 while the second leg 15 is pivoted or moved generally bellow the body 11. This configuration may enable the device 100 to rest on a portion of a billiards table 300 with a leg 14, 15, resting on the play field 301 and the body 11 resting on a cushion 302, and/or rail 303. FIG. 11 illustrates an example of the device 100 in a second exemplary configuration in which both legs 14, 15, are pivoted or moved generally below the body 11. This configuration may enable the device 100 to rest both legs 14, 15 on the play field 301 or other portion of a billiards table 300 so that a billiards ball 400 may pass under the body 11 and between the legs 14, 15, unhindered. FIG. 12 shows an example of a device 100 in a third exemplary configuration in which both legs 14, 15, are pivoted or moved generally above the body 11. This configuration may enable the body 11 of the device 100 to rest on the play field 301 or other portion of a billiards table 300.

While some materials have been provided, in other embodiments, the elements that comprise the device 100 such as the body 11, optional body spur(s) 22, first leg 14, second leg 15, optional leg spur(s) 24, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An adjustable billiards bridge device, the device comprising:

a. a body having a first end and an opposing second end as well as a front side and an opposing rear side, the body having a central cue surface and the body further comprising a first body detent coupled to the front side at the first end and a second body detent coupled to the front side at the second end;

b. a first leg pivotally coupled to the first body detent on the front side at the first end of the body, the first leg having a first peripheral cue surface and the first leg configured to pivot horizontally relative to the body;

c. a second leg pivotally coupled to the second body detent on the front side at the second end of the body, the second leg having a second peripheral cue surface and the second leg configured to pivot horizontally relative to the body; and d. a coupler positioned centrally on the body between the first end and the second end and protruding outwardly from the front side of the body in the same direction as the first body detent and the second body detent thereby blocking the first leg and second leg from rotating 360 degrees.

2. The device of claim 1, wherein the central cue surface is concave in shape.

3. The device of claim 1, wherein a first leg detent is coupled to a first leg rear side and a second leg detent is coupled to a second leg rear side and wherein the first leg rear side, the first leg detent, the second leg rear side, and the second leg detent are each oriented to face the front side of the body.

4. The device of claim 3, further comprising a first leg cap positioned to contact a first leg front side and a second leg cap positioned to contact a second leg front side, the first leg cap and the second leg cap mounted most distal relative to the body.

5. The device of claim 4, further comprising a first leg spring and a second leg spring, the first leg spring positioned between the first leg front side and the first leg cap, and the second leg spring is positioned between the second leg front side and the second leg cap.

6. The device of claim 1, wherein the coupler is configured to be removably coupled to a cue stick.

7. The device of claim 1, wherein the coupler comprises at least two fingers forming an aperture, the fingers configured to move towards each other.

8. The device of claim 7, further comprising a sleeve positioned around the fingers, the sleeve configured to draw the fingers towards each other when the sleeve is moved relative to the body.

9. The device of claim 1, wherein the coupler comprises threading.

10. The device of claim 1, wherein the coupler comprises a bayonet mount.

11. The device of claim 1, further comprising a first body support on the body first end and a second body support on the body second end, the first body support and the second body support protruding downwardly away from the body in an opposite direction as the central cue surface.

12. The device of claim 11, wherein the first body support and the second body support comprise a curved surface suitable for contacting a billiards table.

13. The device of claim 11, wherein the first body support, the second body support, the body, the first leg, and the second leg are configured to form an arch over a billiard ball.

14. The device of claim 1, further comprising a first leg support on the first leg and a second leg support on the second leg.

15. The device of claim 13, wherein the first leg support and the second leg support comprise a curved surface suitable for contacting a billiards table.

* * * * *